US005084924A

United States Patent [19]

Spitz

[11] Patent Number: 5,084,924

[45] Date of Patent: Feb. 4, 1992

[54] MOUNTING APPARATUS FOR WALL BEDS WITH SAFETY JAMMING FEATURE

[76] Inventor: Melvin P. Spitz, 619 N. Elm Dr., Beverly Hills, Calif. 90210

[21] Appl. No.: 626,907

[22] Filed: Dec. 13, 1990

Related U.S. Application Data

[63] Continuation-in-part of Ser. No. 455,162, Dec. 22, 1989, abandoned, which is a continuation-in-part of Ser. No. 143,374, Jan. 12, 1988, abandoned.

[51] Int. Cl.[5] ..... A47C 17/40

[52] U.S. Cl. ..... 5/136; 5/164.1; 5/424

[58] Field of Search ..... 5/164.1, 136, 137, 138, 5/165, 166.1, 424

[56] References Cited

U.S. PATENT DOCUMENTS

| | | | |
|---|---|---|---|
| 1,624,222 | 4/1927 | Duvall | 5/164.1 |
| 1,820,672 | 8/1931 | Muchlinski | 5/164.1 |
| 1,837,211 | 12/1931 | Duvall | 5/164.1 |
| 1,898,578 | 2/1933 | Fox | 5/164.1 |
| 3,179,956 | 4/1965 | Bennett | 5/164.1 |
| 3,464,070 | 9/1969 | Driver | 5/164.1 |
| 3,550,167 | 12/1970 | Bennett | 5/164.1 |
| 4,466,147 | 8/1984 | Yokoi et al. | 5/164.1 |
| 4,901,382 | 2/1990 | Spitz | 5/136 |

*Primary Examiner*—Alexander Grosz

*Attorney, Agent, or Firm*—Plante, Strauss, Vanderburgh & Connors

[57] ABSTRACT

Disclosed is a safety feature for wall beds which provides for jamming of the linkages of a counter-balancing mechanism if anchors for the mounting frame of the counter-balancing mechanism accidentally dislodge.

1 Claim, 3 Drawing Sheets

10
12
16
18
20
22
24
26
28
29
30
32
34
36
38
40
42
46
54
58
62
64
66
X

MOUNTING APPARATUS FOR WALL BEDS WITH SAFETY JAMMING FEATURE

RELATED PATENT APPLICATIONS

This application is a continuation-in-part application of U. S. Ser. No. 07/455,162, filed Dec. 22, 1989, entitled "Mounting Apparatus For Wall Beds," now abandoned, which in turn in is a continuation-in-part patent application of U.S. Pat. application No. 07/143,374, filed Jan. 12, 1988, entitled "Mounting Apparatus for Wall Beds," now abandoned both of these previously filed patent applications are incorporated herein by reference and made part of this application.

BACKGROUND OF THE INVENTION

1. Field of the Invention:

This invention relates to wall beds, and in particular, to a mounting apparatus for such wall beds which has a safety jamming device that prevents injury to anyone in the bed if the wall bed mounting accidentally breaks free from the wall or floor to which it is secured.

2. Background Discussion:

U.S. Pat. No. 4,901,382 discloses typical mounting apparatus used for wall beds. This apparatus includes a mounting frame anchored securely to a wall or floor and a plate attached to the bed base of the wall bed. The mounting frame and plate are connected by an hinge assembly to allow the wall bed to be moved from a closed vertical position to an open, generally horizontal position. In order to assist the user, a counter-balancing spring assembly is connected by a suitable linkage assembly between the plate and mounting frame, so that the weight of the wall bed is counter-balanced during opening and closing. The linkage assembly includes a counter-balancing mechanism such as extension springs, which are in extension when the wall bed is open. These extension springs are connected to the mounting frame.

The problem with such type of counter-balancing mechanism is that the occupants of the bed could be seriously injured if the mounting frame breaks loose from its normally securely anchored positioned. In such event, for example, the extension springs would pull the mounting frame rapidly towards the headboard, striking the back of the headboard and causing it to slam down onto the heads of the occupants of the wall bed. There has been one or more instances where this has occurred with wall beds of conventional design, resulting in serious head injuries to occupants of the wall bed.

SUMMARY OF THE INVENTION

It is the objective of the present invention to provide a mounting for a wall bed which includes a jamming element that prevents the mounting from injuring occupants of the wall bed if the mounting accidentally breaks free from its anchor.

BRIEF DESCRIPTION OF THE DRAWING

The preferred embodiment of this invention, illustrating all its features, will now be discussed in detail. This embodiment depicts the novel and non-obvious apparatus of this invention shown in the accompanying drawing, which is for illustrative purposes only. This drawing includes the following FIGS., with like numerals indicating like parts.

DETAILED DESCRIPTION OF THE PREFERRED EMBODIMENT

Figure 1:
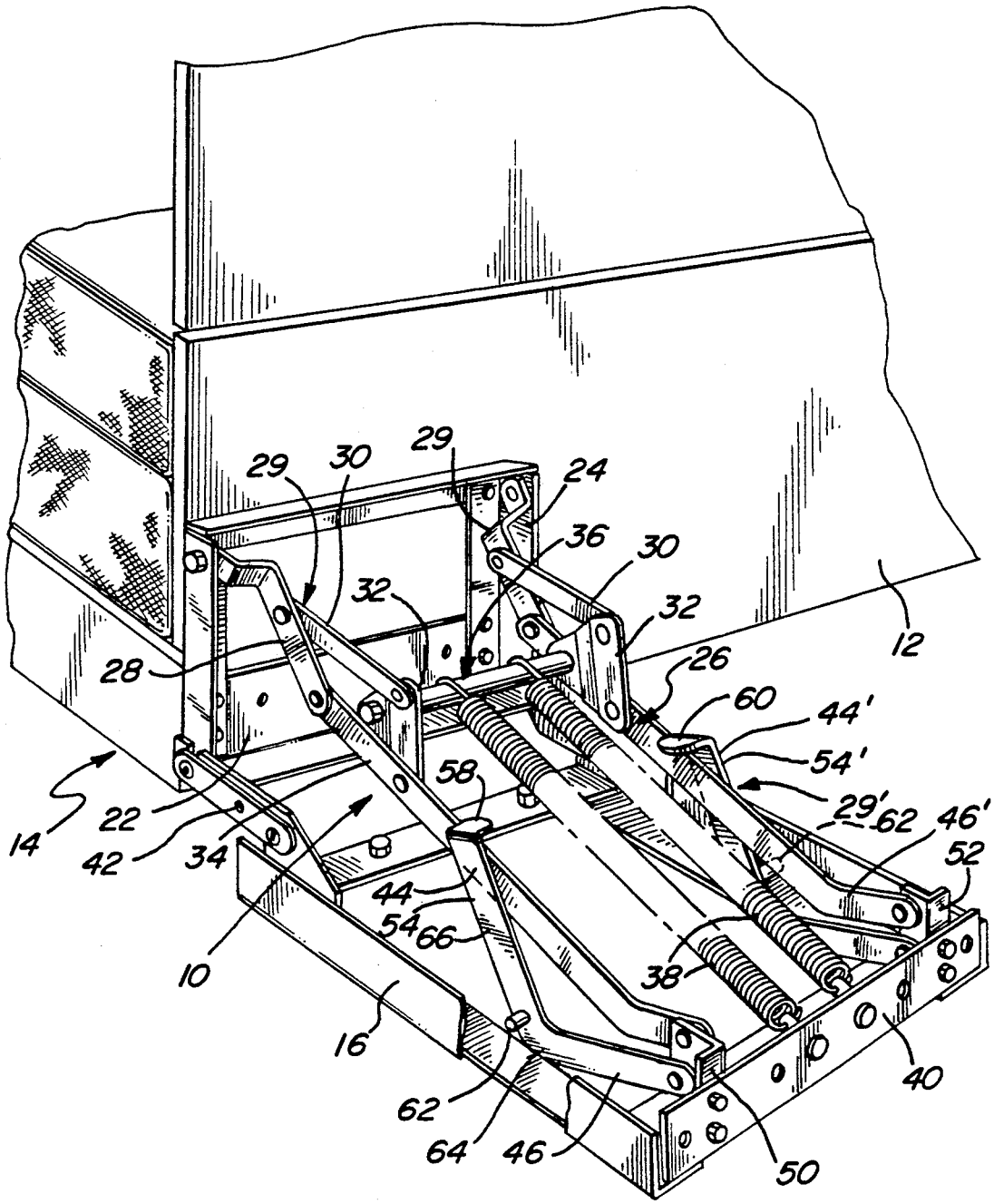
FIG. 1 is a perspective view of the counter-balancing spring assembly of this invention.

As illustrated in FIGS. 1 through 4, the counter-balancing spring assembly 10 of this invention is connected between a bed base 12 of a wall bed 14 and a mounting frame 16 secured by anchors 18 to a floor 20. This counter-balancing spring assembly 10 includes a plate 22 secured to the bed base 12, a bracket 24 attached to the plate, and a linkage assembly 26 mounted between the bracket and the mounting frame 16. The linkage assembly 26 is substantially the same as the one illustrated in U.S. Pat. No. 4,901,382. This linkage assembly 26 includes two essentially identical linkages 29 and 29' each having the links 28,30, 32, and 34. The linkages 29 and 29' are connected together by a post 36 so that they move in unison with the opening and closing of the wall bed 14. Extension springs 38 are connected between a rear plate 40 of the mounting frame 16 and the post 36, so that when the wall bed 14 is in the horizontal position as illustrated in FIG. 1, the springs 38 are in tension. A hinge mechanism 42 connects the bracket 24 and mounting frame 16 together so that the wall bed can be moved from the horizontal position to a vertical position about the pivot point X.

Figure 4:
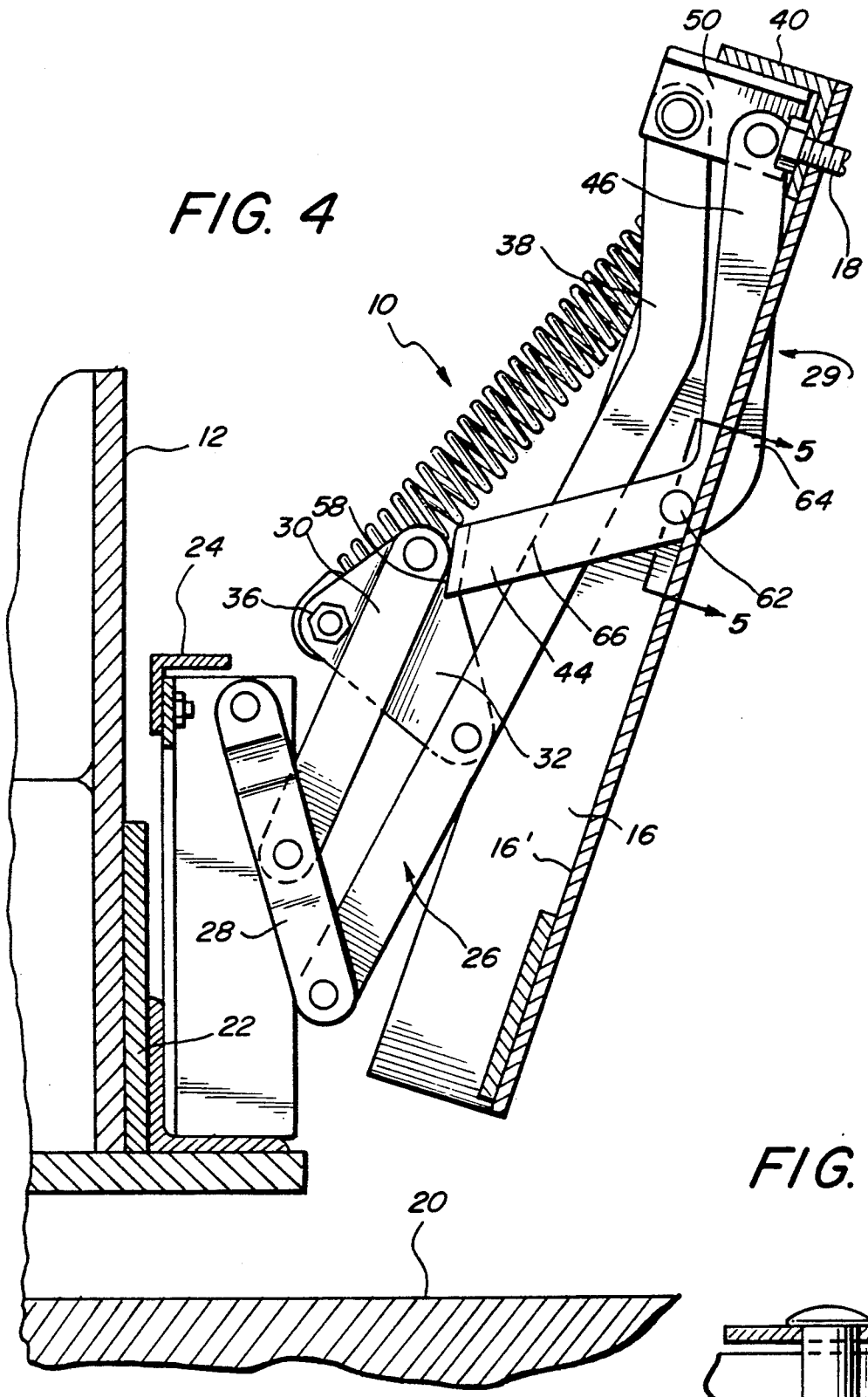
FIG. 4 is a side elevational view, partially in cross-section and similar to that shown in FIG. 2, showing the mounting frame breaking loose from its anchor.
Figure 5:
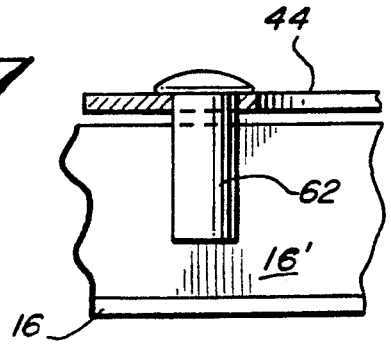
FIG. 5 is a cross-sectional view taken along line 5—5 of FIG. 4.

In accordance with this invention, a pair of jamming elements 44 and 44' are provided, respectively, to interact with the linkages 29 and 29' to prevent the mounting frame 16 from crashing into the bed base 12 if it accidentally breaks loose from its anchors 18, as illustrated in FIG. 4. These jamming elements 44 and 44' are generally L-shaped arms, with each arm having pivoted ends 46 and 46', respectively, and free ends 54 and 54', respectively, and bent at about a 90° angle to form elbows 64. The end 46 of the jamming element 44 is pivotally connected to a bracket 50 attached to the rear plate 40 of the mounting frame 16. The end 46' of the jamming element 44' is pivotally connected to a bracket 52 attached to the rear plate 40 of the mounting frame 16. At each of the free ends 54 and 54' are inwardly extending tabs 58 and 60, respectively. Near the elbows 64 in each jamming element 44 and 44' is an outwardly projecting stop-pin 62.

Figures 2, 3:
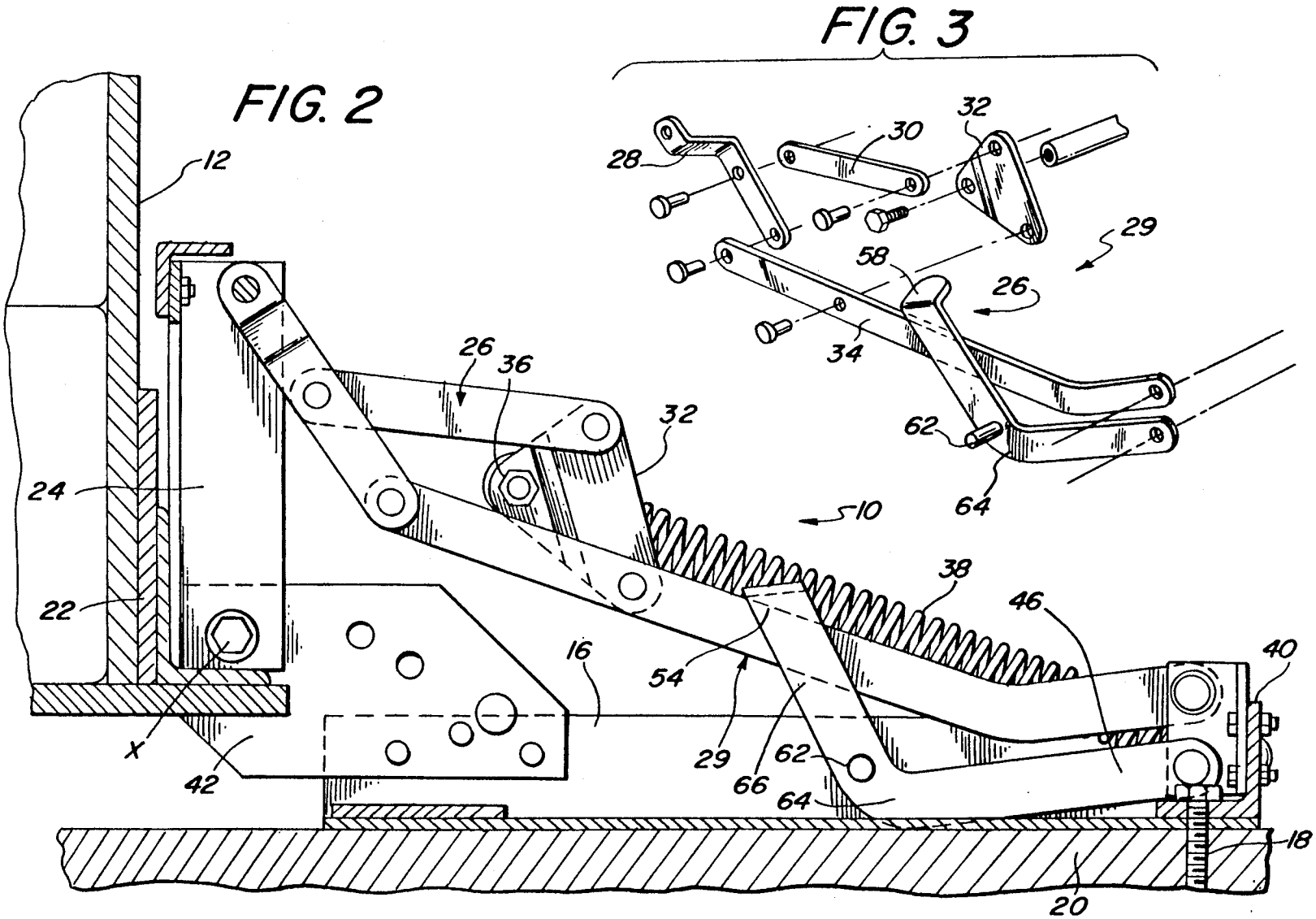
FIG. 2 is a side elevational view, partially in cross-section, of the counter balancing spring assembly shown in FIG. 1.
FIG. 3 is an exploded perspective view of the linkage sub-assembly with a jamming element.

As shown in FIG. 2, when the wall bed 14 is opened and in the generally horizontal position, each of the jamming elements 44 and 44' rests at the elbows 64 on the floor 20. With the elbows 64 resting on the floor 20, the tabs 58 and 60, respectively of the jamming elements 44 and 44', are positioned so they do not engage any of the links 28, 30, 32, or 34 of the linkages 29 and 29' during opening and closing of the wall bed 14. Thus, the jamming elements 44 and 44' do not interfere with the normal operation of the wall bed 14. In contrast, if the mounting frame 16 breaks loose from its anchors 18 as depicted in FIG. 4, the jamming elements 44 and 44' pivot about their respective ends 46 and 46', dropping downward past the mounting frame 16, to move the tabs 58 and 60 respectively into positions to engage the links 30. Thus, the jamming elements 44 and 44' move relative to the mounting frame 16 only when the mounting frame moves away from the floor 20 by breaking free from its anchors 18. When this occurs, the stop pins 62 engage a bottom section 16' of the mounting frame 16. Thus, the section 66 of each the jamming elements 44 and 44' is wedged between the linkages 29 and 29' and the mounting frame 16, preventing the mounting frame from crashing against the bed base 12 and potentially causing injury to the occupants of the wall bed 14. This simple, but very effective safety feature, can be easily retrofited on existing counter balancing spring assemblies of the type illustrated in U.S. Pat. No. 4901,382.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims:

I claim:

1. In a counter-balancing assembly connected between a bed base of a wall bed and a mounting element normally anchored in position to a wall or floor, said counterbalancing assembly having means connected to a linkage assembly to provide a counter balancing force as the bed is being opened and closed, the improvement, comprising a safety element moveable between a first position that allows the linkage assembly to clear the safety element when the bed is being opened and closed, and a second position wherein the safety element interacts with the linkage assembly to jam that assembly whenever the mounting element breaks free from its anchored position.

* * * * *